US007849624B2

(12) United States Patent
Holt et al.

(10) Patent No.: US 7,849,624 B2
(45) Date of Patent: Dec. 14, 2010

(54) SYSTEMS AND METHODS FOR QUALIFIED REGISTRATION

(75) Inventors: Jason J. Holt, Scottsdale, AZ (US); Patrick W. Smith, Scottsdale, AZ (US); Magne H. Nerheim, Paradise Valley, AZ (US); Ryan C. Markle, Peoria, AZ (US)

(73) Assignee: TASER International, Inc., Scottsdale, AZ (US)

( * ) Notice: Subject to any disclaimer, the term of this patent is extended or adjusted under 35 U.S.C. 154(b) by 767 days.

(21) Appl. No.: 11/419,796

(22) Filed: May 23, 2006

(65) Prior Publication Data

US 2007/0271830 A1 Nov. 29, 2007

(51) Int. Cl.
*F41A 17/00* (2006.01)

(52) U.S. Cl. ..... 42/70.01; 42/70.08; 340/5.81

(58) Field of Classification Search ..... 42/70.08, 42/70.11, 70.01; 340/5.8, 539.11, 5.81
See application file for complete search history.

(56) References Cited

U.S. PATENT DOCUMENTS

| | | | |
|---|---|---|---|
| 4,541,191 | A | 9/1985 | Morris |
| 4,591,854 | A | 5/1986 | Robinson |
| 4,884,809 | A | 12/1989 | Rowan |
| 5,193,048 | A | 3/1993 | Kaufman |
| 5,461,812 | A | 10/1995 | Bennett |
| 5,502,915 | A | 4/1996 | Mendelsohn et al. |
| 5,537,771 | A | 7/1996 | Martin |
| 5,684,454 | A | 11/1997 | Nishioka et al. |
| 5,715,623 | A | 2/1998 | Mackey, III |
| 5,915,936 | A | 6/1999 | Brentzel |

(Continued)

FOREIGN PATENT DOCUMENTS

| | | |
|---|---|---|
| EP | 1605222 | 12/2005 |

OTHER PUBLICATIONS

BMW Motorrad, Supplemental Rider's Manual (US Model) Anti-Theft Alarm System DWA5, Order No. 01477685677, Aug. 2003.

*Primary Examiner*—Stephen M Johnson
(74) *Attorney, Agent, or Firm*—William R. Bachand

(57) ABSTRACT

A product is sold at retail in an unusable state. Activation of the product does not require any steps be taken by the retail seller. To activate the product, the purchaser uses a phone or personal computer to interact with a registration server for this type of product. Alter the consumer has provided sufficient identifying information, the registration server interacts with a qualification server that determines whether the purchaser meets the qualifications set for this type of product. For a weapon sale, this is typically a criminal background check. If qualified, the registration server receives an indication of qualification from the qualification server. The registration server and product communicate over a network to establish trust, store information in the product, and then activate the product. The product receives information via a network appliance, for example, a phone or personal computer. The receiver may sense sound from a speaker or light from a display of the network appliance. The product transmits information onto the network directly when the network appliance has a suitable receiver. Otherwise, the product provides the information to the purchaser who enters the information into a user interface of the network appliance. The user interface may perform voice recognition or accept data via a pointing device or keyboard. The serial number of the product is transmitted to the registration server. A description of the purchaser and/or qualification results are stored in the product.

34 Claims, 7 Drawing Sheets

U.S. PATENT DOCUMENTS 5,924,232 A 7/1999 Rhoden
5,936,183 A 8/1999 McNulty, Sr.
5,937,557 A * 8/1999 Bowker et al. ..... 42/70.01
5,953,844 A 9/1999 Harling
6,237,461 B1 5/2001 Poole
6,314,671 B1 11/2001 Gering
6,408,555 B1 6/2002 Sapia et al.
6,408,905 B1 6/2002 Lee
6,421,943 B1 * 7/2002 Caulfield et al. ..... 42/70.11
6,429,769 B1 8/2002 Fulgueira
6,823,621 B2 11/2004 Gotfried
6,833,787 B1 12/2004 Levi
6,856,238 B2 2/2005 Wootton
6,918,519 B2 7/2005 Vor Keller et al.
7,088,387 B1 8/2006 Freeman et al.
7,168,198 B2 * 1/2007 Newkirk et al. ..... 42/70.11
7,237,117 B2 6/2007 Weiss
7,376,494 B2 * 5/2008 Arnouse ..... 701/3
7,389,604 B2 * 6/2008 Newkirk et al. ..... 42/70.11
2005/0257411 A1 11/2005 Wootton
2005/0262751 A1 * 12/2005 Leslie ..... 42/70.01
2007/0180749 A1 * 8/2007 Schumacher et al. ..... 42/70.01

* cited by examiner

SYSTEMS AND METHODS FOR QUALIFIED REGISTRATION

FIELD OF THE INVENTION

Embodiments of the present invention relate to registration of a qualified person prior to permitting use of an apparatus.

BACKGROUND OF THE INVENTION

Sales of weapons to consumers for sport shooting and self-defense have long been regulated in an attempt to reduce the possibility that these weapons will later be used for criminal purposes. Typically, the identity of the purchaser is compared with records from a law enforcement agency to prevent the sale of a weapon to a person known to have used a weapon illegally in the past. The collection and comparison steps burden the weapons seller who would prefer the freedom to sell weapons in the same manner as unregulated goods.

Conventional methods for selling weapons have included the sale of a weapon that cannot be used until a lock or holster is removed. One such lock physically blocks use of the trigger. One such holster encloses all of the weapon except a portion of the handle. Removal of the lock requires the seller to obtain identification information from the purchaser, complete a criminal background check using the information, receive a code, and teach the purchaser how to input the code into the lock. Removal of the holster requires the seller to obtain a fingerprint of the purchaser, perform a criminal background check using the fingerprint data, unlock the weapon from the holster using a retailer's code, input the fingerprint data into a circuit of the holster, and teach the purchaser how to unlock the holster using a biometric sensor of his or her fingerprint.

The prior art systems are cumbersome and add to the burden placed on the seller. Systems and methods are needed to facilitate selling weapons with no additional involvement by the seller. Without systems and methods of the present invention, sales of weapons will continue to be limited, for example, by processes and special purpose equipment that are burdensome on the seller.

SUMMARY OF THE INVENTION

A weapon, according to various aspects of the present invention, includes a processor and a receiver. The processor performs a function of the weapon only after a condition is met. The receiver provides to the processor a code received from a provided network. The condition is met in accordance with the code.

Another weapon, according to various aspects of the present invention, includes a logic circuit, a receiver, and a memory. The receiver detects a first signal that originated outside the weapon and provides, in response to the first signal, a second signal to the logic circuit. The memory stores indicia of an inactive state, a providing state, and an active state. A function of the weapon is not operational in the inactive state and is operational in the active state. The logic circuit, in the providing state, provides information to the user of the weapon. Transition into the active state follows determining by the logic circuit that the second signal is consistent with the information.

A method, according to various aspects of the present invention, is performed by a weapon. The method includes in any practical order: (a) providing a first code to a user of the weapon; (b) receiving a second code from a network, the network providing the second code in response to the first code that was provided to the network by the user; (c) determining whether the first code is consistent with the second code to produce a result of determining; and (d) enabling an operation of the weapon in accordance with the result.

Another method, according to various aspects of the present invention, is performed by a weapon. The method includes in any practical order: (a) interacting with a user of the weapon to receive a first code; (b) determining whether the first code is consistent with a second code in a memory of the weapon to produce a result of determining; and (c) enabling an operation of the weapon in accordance with the result. Interacting may include monitoring a switch that is operated by the user. Receiving may include determining the first code in accordance with a time between successive operations of the switch.

Another method, according to various aspects of the present invention, is performed by a weapon. The method includes in any practical order: (a) interacting with a user of the weapon to provide to the user a first code and to receive from the user a second code: (b) determining whether the first code is consistent with the second code to produce a result of determining; and (c) enabling an operation of the weapon in accordance with the result.

A method for qualified registration, according to various aspects of the present invention is performed by a server coupled to a network. The method includes in any practical order: (a) receiving via the network a request for registering a user for a product being at least one of a weapon, an accessory for a weapon and ammunition for a weapon: (b) providing via the network a first inquiry; (c) receiving via the network a first answer to the first inquiry; (d) providing, to a second server coupled to the network, first information in accordance with the first answer; (e) receiving from the second server a second inquiry; (f) providing via the network the second inquiry; (g) receiving from the network a second answer; (h) providing to the second server second information in accordance with the second answer, wherein at least one of the first answer and the second answer describe the user; (i) receiving from the second server indicia that the user meets a predetermined qualification; (j) recording registration of the user in association with the product; and (k) providing via the network a code to the product that enables use of the product.

BRIEF DESCRIPTION OF THE DRAWINGS

Embodiments of the present invention will now be further described with reference to the drawing, wherein like designations denote like elements, and.

DETAILED DESCRIPTION OF THE PREFERRED EMBODIMENTS

Figure 1:
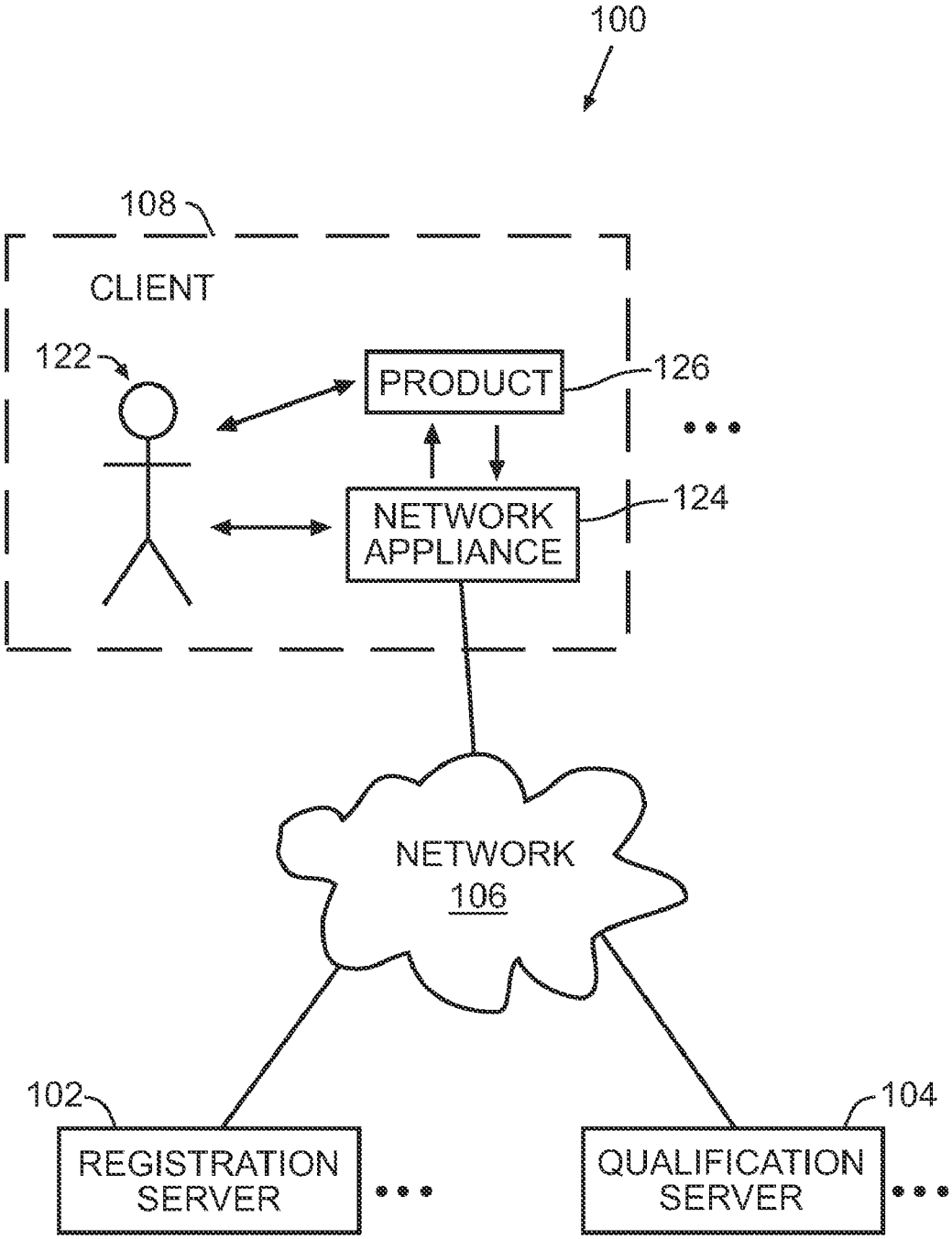
FIG. 1 is a functional block diagram of a network environment for registering a qualified applicant according to various aspects of the present invention.

According to various aspects of the present invention, a function of a product is to be allowed to be used only after a person successfully completes a method for qualified registration. In an application of systems and methods of the present invention, the person typically has possession of the product. Possession may be a result of purchasing the product from a seller, receiving the product from a donor as a gift, or being allowed use of the product owned by another. Registration may result in one, some, or all functions of the product becoming enabled for use. Typically, an applicant completes a method for qualified registration by providing information that meets qualification criteria to permit the applicant to use the product. Systems and methods of the present invention are intended to make it difficult for qualified registration to be completed by someone other than the user of the product. For example, the applicant for qualified registration must have possession of the product and must be able to supply information that is unlikely anyone other than the applicant would be able to supply. If registration by an agent of the user is not desired, systems and methods of the present invention may require provision of information extremely unlikely to be known by anyone other than the user and/or may require biometric information unique to the user.

In an important class of implementations according to various aspects of the present invention, use is permitted for an indefinite period of time following registration. In another important class of implementations according to various aspects of the present invention, use is permitted for a period that expires on a predetermined event or on the first to occur of a set of predefined events. An event is detected by the product to disable one, some, or all functions of the product. An event may include lapse of a predetermined amount of time, the current date and/or time reaching a terminating date and/or time, a quantity of uses of the product, misuse of the product, or a reset of the product via a user interface of the product or via a covert interface of the product.

Qualified registration produces an association of a description of a user and a description of the product when one or both of the descriptions are consistent with qualification criteria. Qualified registration also produces a message or signal conveying, information that enables one, some, or all functions of the product. Qualified registration may be completed in a network environment. In an important class of implementations according to various aspects of the present invention, a method for qualified registration includes determining whether sources of information conveyed on the network are trustworthy. Sources of information conveyed by the network include a registration server, the applicant, and the product. The applicant and the product provide information via one or more network appliances that are coupled to the network. The product may include a network appliance for information provided by the product and/or for information provided by the applicant.

Systems and methods according to the present invention address one or more of the following trust issues: (a) whether the applicant is a person; (b) whether the information provided by the applicant uniquely identifies the person intending to be the user of the product; (c) whether the person intending to be the user of the product is intending to be an exclusive user of the product; (d) whether the person intending to be the user of the product is likely to be an exclusive user of the product; (e) whether information purportedly supplied by the product is likely to have been supplied by a product (as opposed to a subversive apparatus); (f) whether information purportedly supplied by the product is likely to have been supplied by the product that is in the possession of the applicant; and (g) whether information purportedly supplied by a registration server is likely to have been supplied by a registration server (as opposed to a subversive apparatus). Systems and methods according to various aspects of the present invention address these issues to decrease to an acceptable minimum the risk that a product will be enabled for use by a person who does not actually meet the qualification criteria. Practice of the present invention limits the quantity of products able to be used by unqualified persons.

Qualified registration, according to various aspects of the present invention, may be accomplished with the exchange of a series of messages between the applicant, the product, a registration server, and a qualification server. A network environment for communication relieves the requirement that these entities be physically hardwired together or within range of communication. A network may be omitted when communication via wired connections or physical co-location is feasible. Use of two types of servers, specifically a registration server and a qualification server, permits different economic entities to manage each type of server. The registration server and qualification server functions may be hosted by a single server if desired.

Qualified registration may be accomplished with a division of functions in a network environment of the type described with reference to FIGS. 1 through 5. Network environment 100 of FIG. 1 includes one or more registration servers of which registration server 102 is typical, one or more qualification servers of which qualification server 104 is typical, a network 106 that provides communication between servers and network appliances, and, for each session of qualified registration, a client of which client 108 is typical. Client 108 includes an applicant for registration 122, a network appliance 124 coupled to network 106, and a product 126 that is able to communicate with network appliance 124. Each particular client (e.g., 108) presents a unique instance of subject matter (a particular tuple) for registration involving at least the identity of a person of applicant (e.g., 129) and the identity of a product (e.g., 126). Client/server network environment 100 supports an indefinite number of simultaneous instances of subject matter for registration.

Messages are conveyed among entities (e.g., servers and network appliances) by the network in a manner that permits an entity to direct a message to another entity using a unique address of the entity; and to receive messages that were addressed to itself by another entity. Unfortunately, subversive activity may also be supported by the network including an entity intentionally receiving messages not addressed to that entity and an entity sending messages using an address that belongs to another entity. Systems and methods according to various aspects of the present invention greatly reduce the possibility that such subversive activities result in unauthorized activation of product functions.

A network includes any communication topology that supports a sequence of communication of a type described with reference to FIGS. 2A through 2D. Communication may include messages and/or signals in any conventional technology, format, and modulation. For example, network 106 includes conventional hardware and software for a global digital communication network for controls, data, voice, and/or images (e.g., a TCP/IP network, a GSM network, a CDMA network, a Bluetooth network extension, a proprietary protocol network). Network 106 may include a combination of network topologies and protocols with suitable conventional links and bridges.

A server includes any computer system having conventional hardware and software for performing conventional network communication processes. Server processes include communication, database management, and synchronized keeping of date and time information. A server is a type of computer designed with an emphasis on high volume communication and, in some cases, high volume transactions involving data storage. A registration server 102 is a server that also performs a registrar process. A qualification server 104 is a server that also performs a qualifier process. Network server, registrar, and qualifier processes typically: (a) determine the information and format the messages conveying such information to be provided via the network, (b) receive messages from the network and determine received information from such messages, and (c) respond to received information. Responding may include determining information to be provided in accordance with and/or in response to information received. Depending on the network protocol(s) selected for particular information, messages, and signals, servers may include suitable hardware and software for control and data processing (e.g., database management, back office subsystems), voice processing (e.g., voice automated subsystems, automated telephone subsystems), and/or image processing (e.g., determining information from an image such as identifying persons, products, and text).

A registration server 102 and a qualification server 104 may communicate via a link (not shown) for secure communication or cost accounting. Such a link may be separate from and/or different from network 106. Either network 106 or a link not part of network 106 may be used as a primary or secondary channel for communication between a registration server and a qualification server. Information to be communicated may be communicated via either or both the network and the link for trust, security, redundancy, or efficiency.

A network appliance includes any electronic device having a network communication capability and a user interface. A network appliance is a type of computer with a design emphasis on supporting both a sophisticated or special purpose network interface and a sophisticated or special purpose user interface. Conventional network appliances include, for example, computer work stations, personal digital assistants, and cellular phones. Conventional user interfaces include: a graphical user interface, a menu driven user interface, a keypad user interface (e.g., QWERTY, 12-key phone pad), a user interface comprising special purpose controls and indicators (or a display). According to various teachings of the present invention, an aspect of the user interface of a network appliance may be used to communicate messages and/or signals to a product. A conventional computer workstation monitor or the speaker may be used. A conventional display or speaker of a personal digital assistant or cell phone may be used. For example, a physical region of the display or a frequency band of a speaker may be used for communicating with a type of product having a receiver for light and/or sound. Use of a portion of the user interface for communicating with a product may be accomplished with additional software accepted and performed by the browser. A network appliance may also have other interfaces through which communication to a product may be accomplished. For example, any conventional cable interface may be used (e.g., a printer interface, USB interface). A wireless interface may also be used (e.g., a Bluetooth interface). For simplicity of product hardware, a self clocking serial interface is preferred.

In one implementation, network appliance 124 may include a processor, a text and (graphics display, a speaker, a QWERTY keyboard, and a mouse. Network appliance 124 may further include a conventional browser for network communication and software performing a graphical user interface. Network appliance 126 in this implementation may further include a browser having a Java Virtual Machine that accepts applets for processes that support communication to product 126 (e.g., 210, 214). Communication between the browser and the network may include protocols for information exchange such as HTTP, HTML, XML, and forms interfaces (e.g. WinForms marketed by Microsoft Corp.)

A registration server and product may communicate in part via a link (not shown) not supported through a network appliance. Such a link may be separate from and/or different from the channel that includes network 106 through the network appliance. Either the channel through the network appliance or the link may be used as a primary or secondary channel for communication. Portions of the information to be communicated may be communicated via either or both the channel through the network appliance and the link for trust, security, redundancy, or efficiency.

An applicant is capable of receiving information from a user interface of the product and providing information to a network appliance. According to various aspects of the present invention, the interfaces and the information suitably make it difficult to replace a person with a process in place of the applicant.

An interface between the network appliance and the applicant may include a conventional controls and displays including a graphical user interface with pointing device, a menu driven interface with navigation button(s), a command line interface with a QWERTY keyboard, or a special purpose manual switch and indicator interface.

A product includes any process or device capable of communicating with a network appliance and an applicant. A process type product may be hosted on a network appliance (e.g., the same or different from network appliance 124). The product may include processing software or logic circuitry for establishing trust between the product and a registration server. The product may include memory that stores a logical state of the product, software, and/or information received frown a network appliance.

An interface between the product and the applicant may inform the applicant via visual and/or audio techniques for the applicant to see and/or hear. A conventional display may be used (e.g. light emitter, light reflector, light refractor) for alphanumeric, numeric, or binary indications. Binary user interfaces may include blinks of light or audio beeps (e.g. presence/absence of particular pitches, harmony, quantity of beeps, durations of beeps, Morse code). A conventional sound emitter may be used (e.g., speaker, transducer) for audible information (e.g., voice, tones, DTMF, telephone modem signals).

An interlace between the product and a network appliance (or registration server) may include any conventional messaging and/or signaling capabilities. For a product comprising an enclosed device, such an interface may be wireless to preserve an hermetic seal of the enclosure. For example, a serial interface using a self clocking modulation (e.g., a Manchester code) may be used to allow for variation in the processing capability and protocol(s) of the network, network appliance (or registration server). The serial interface may be single ended or differential (for common mode signal rejection).

One or more optical channels may be used. For example, a product comprising an enclosure may include a transparent or translucent portion of the enclosure for light from a display to be detected inside the enclosure. Such a product may be held close to a display of the network appliance. All or part of the display may show an outline of the product for proper orientation of the product against the display. All or part of the display may be modulated in color and/or intensity (e.g., black/white shift keyed) to communicate from the network appliance through the enclosure to a detector of the product.

One or more magnetic channels and/or electrostatic channels may be used in a manner analogous to the optical channels discussed above. A product shaped as removable magnetic media nay be inserted into a drive for such media. Communication may be optical, magnetic, or electrostatic.

An audio channel may be used (e.g., microphone, transducer). The product may be held close to the speaker of a network appliance (e.g., a telephone, personal computer, personal digital assistant).

A radio channel may be used (e.g., a CDMA, GSM, Bluetooth, IEEE 802). Communication over the radio channel may be controls, data, voice coded as data, and/or images coded as data. For example, when the interface into the product includes a cellular phone link, any conventional control (e.g., the caller ID) may convey information.

Figure 2A:
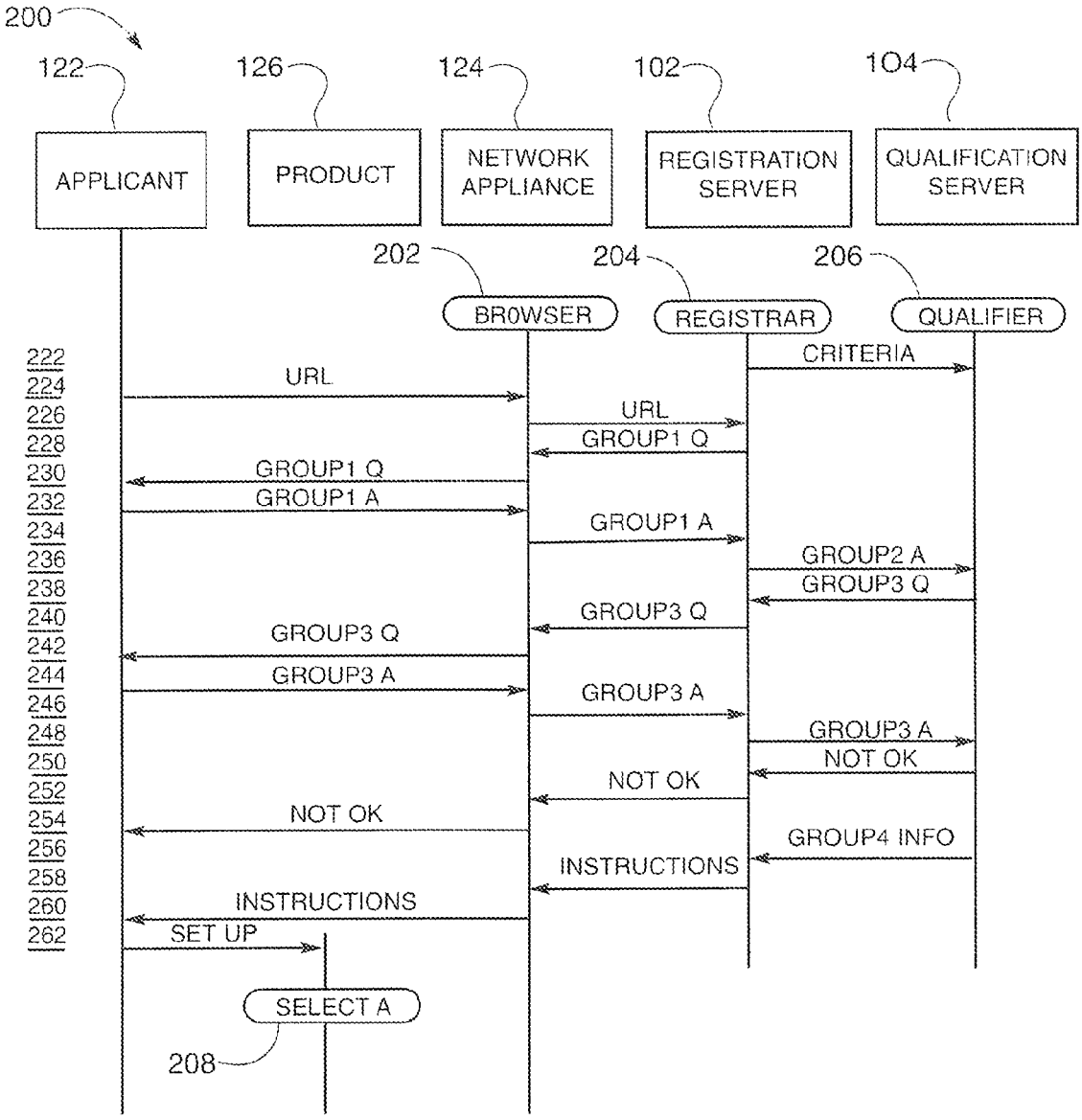
FIGS. 2A and 2B present a message sequence diagram of a method for qualified registration in the environment of FIG. 1.
Figure 2B:
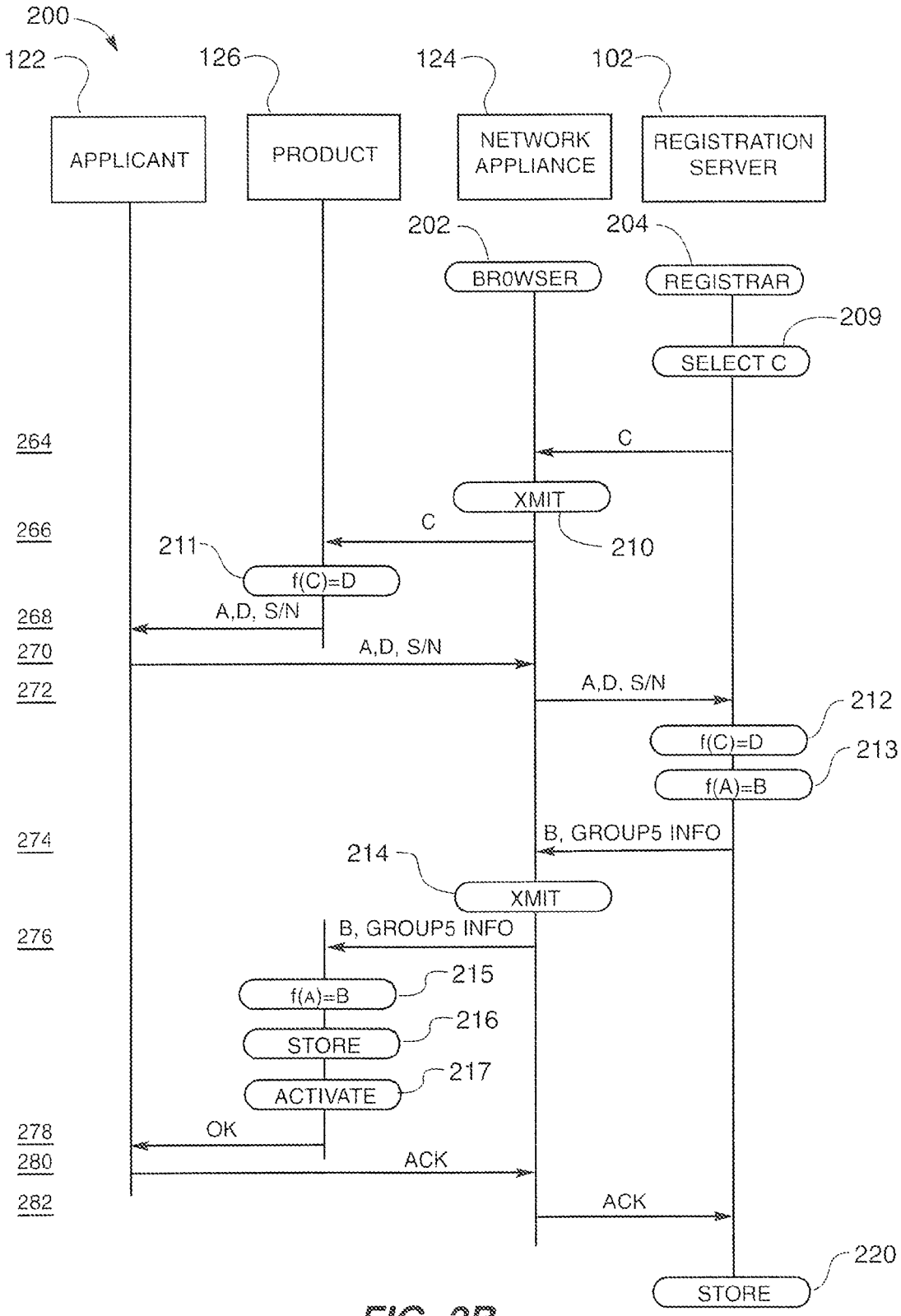

The servers and clients of environment 100 may cooperate for a qualified registration using signals and/or messages of the type described with reference to a sequence of messages 200. Sequence 200, of FIGS. 2A and 2B provides a plan for implementations of various aspects of the present invention. For example, in an important class of implementations, all of the illustrated communications occur in the order illustrated, proceeding in time vertically toward the bottom of the figure. Particular times are indicated 222 through 282. In other important classes of implementations the time sequence of communication may differ from that shown and/or some signals and/or messages may be combined or omitted. Some of these variations will be noted below. Others will be apparent to a person of ordinary skill applying the teachings herein.

In exemplary sequence 200, registration server 102 is managed by a manufacturer of product 126. Qualification server 104 is managed by a financial services organization able to gather and keep up to date personal information describing millions of persons (e.g., Checkpoint). In one implementation of sequence 200, product 126 is an electronic control device, herein referred to as a weapon 126, sold in an inactive state. Activation is conditional on qualified registration involving a criminal background check. For instance, an applicant for registration that is identified to a criminal background that includes a felony conviction or a violent misdemeanor is denied use of weapon 126.

For initialization and/or configuration management, registrar process 204 operating on registration server 102, as a one time initialization or as needed for reconfiguration, may define qualifications (222) to qualifier process 206 operating on qualification server 104. Defined qualifications indicate to the qualifier process 206 what criteria are suitable for qualifying a registrant for the particular types of products expected to be registered. Qualifications of an applicant may include personal criteria (e.g., age, sex, race, appearance, height, weight) demographic criteria (e.g., nationality, languages, residence addresses and durations, employer names and durations) economic criteria (income history, income tax history, auto registrations, residence values, property tax history, credit activity, credit scores) and legal background criteria (criminal convictions, pending suits, traffic violations, liens, licenses, regulatory agency status)). Criteria may be stated as ranges, limits, acceptable alternatives, or unacceptable alternatives. Different dimensions may be weighted and combined for one or more comprehensive measures. The format of the information provided by registrar process 204 and qualifier process 206 may be specified (part of an agreed interface specification) to streamline communication. For registration of weapon 126, the requirement for no felony convictions may be part of the defined qualifications (222).

When applicant 122 has possession of weapon 126 to register, applicant 122 reads from the product packaging (or other printed material provided with weapon 126) some initial instructions explaining how to gain access to registrar process 204 via a browser 202 of network appliance 124. For a TCP/IP network, access generally requires input (224) of a uniform resource locator (URL) into browser process 202. Browser process 202 forwards (226) the URL, to registrar process 204. Network appliance 124 may have a network address suitable for use as a qualification (e.g., a personal phone number or GSM address when network appliance 124 is a personal cellular phone, a MAC address or IP address when network appliance is a personal workstation). In other implementations, applicant 122 may use any network appliance (e.g., a public workstation at a public library) because sufficient identification criteria can be satisfied without the network address of network appliance 124.

Registrar process 204 responds (228) to the URL with one or more presentations that include information and questions (group one questions) presented (230) to applicant 122 by browser process 202. The information may teach the applicant that a person registered to use the product is presumed to be the exclusive user of the product. The information may further recommend ways to protect his or her reputation as a qualified person, for example, by employing recommended physical security measures suitable for the product. Group one questions may request information identifying the applicant and identifying the product (e.g., type of product). The type of product may be used to determine which of several sets of defined qualifications (herein also called criteria (222)) apply in this instance of qualified registration.

Information requested to identity the applicant may include name, (late of birth, social security number, driver's license number, current address, telephone numbers, and/or current employer name.

Applicant 122 responds (232) with answers (group one answers) that are forwarded (234) by browser process 202 to registrar process 204. Registrar process 204 formats the information received and provides (236) a comprehensive set of answers (group two answers) to qualifier process 206. Group two answers are typically sufficient for qualifier process 206 to identify applicant 122 in records available to qualification server 104 (e.g., a database, not shown).

Qualifier process 206 may determine whether the group two answers meet the criteria stated or implied by the defined qualifications (222) (and possibly other qualifications used by the operator of qualification server 104) and respond to the group two answers with a result of qualification (250 or 256). In many cases, qualifier process 206 may seek additional information to assure identification, assure qualification, and/or to update its records. If so desired, qualifier process 206 spay provide (238) to registrar process 204 additional questions (group three questions) that are forwarded (240, 242) to applicant 122. Group three questions may request a prior name, prior states where licensed to drive, children's or parent's names or birth dates, prior addresses, and/or names of prior employers. Applicant 122 provides (244) another group of answers (group three answers) that are forwarded (246) by browser process 202 and forwarded (248) by registrar process 204 to qualifier process 206. Group three questions may require knowledge of information very likely exclusively known by applicant 122. Group three questions establish the identity of applicant 122 to a degree of certainty that may be specified by defined qualifications and/or by qualifications set by the operator of qualification server 104.

Consequently, qualifier process 206 may issue (250) indicia of a failure of qualification that is forwarded (252, 254) subsequently to the applicant. In accordance with defined qualifications (222) or a policy of qualification server 104 management (e.g., describing types of information for registrar process 204), qualifier process 206 may provide (250) information in addition to mere binary indicia of failure status for storage by registrar process 204. A failure of qualification terminates qualified registration and dispenses with the client-server session (if any) regarding the initial request (224). Note that the product function requiring qualified registration has not been enabled and is consequently not allowed to be used. Any information describing the registration attempt that may have been handled by registrar process 204 may be stored by registrar process 204 on registration server 102. Any information describing the qualification attempt that may have been handled by qualifier process 206 may be stored by qualifier process 206 on qualification server 102.

On the other hand, if qualification is determined by process 206 to be successful (e.g., all criteria are met within acceptable limits), indicia of qualification is provided (256) to registrar process 204. Additional information besides a binary result of qualification may be included as group four information. Registrar process 204 may retain the group four information until a trusted channel is established between registrar process 204 and product 126.

If the additional requirements for trusted communication between registrar process 204 and product 126 need not be met (e.g., undesired complexity), messages and/or signals 264 through 272 may be omitted and consistent revisions made to the remaining communications. In such a simplified implementation of sequence 200, instructions may next be provided (258) by registrar process 204 to browser process 202 and presented (260) to applicant 122. Instructions inform the applicant how to prepare the product for communication with network appliance 126. Applicant 122 performs (262) product configuration according to the instructions and may physically position and/or orient product 126. For example, when product 126 is a weapon having a safety switch and having an interface to a network appliance that includes a receiver for detecting a series signal modulated with a self clocking code and produced by a portion of a conventional CRT monitor display of an otherwise conventional workstation implementation of network appliance 124, then the instructions may direct the applicant to (a) set the safety switch to the "on" position so that power is applied to the receiver and other circuits of the weapon; (b) hold the weapon against the face of the monitor and within an outline presented to the applicant on the monitor (e.g., with the instructions) so that the receiver is aligned immediately adjacent the portion of the display surface that is modulated for communication to the weapon; and (c) refrain from moving the weapon away from the face of the monitor or outside of the outline for at least a suggested minimum period of time (e.g., two minutes) or until complete registration is indicated (278) by a user interface of the weapon.

While the product is set up for communication with network appliance 124, group five information may be provided (274) by registrar process 204 to browser process 202 and forwarded (276) to product 126. Group five information may include all, some, or none of (group four information; and, may further include any information available to registrar process 204 such as identification of a particular registrar process 204, registration server 102, qualifier process 206, qualification server 104, duration, date and time of qualification and/or registration, any portion of the defined qualifications (222), any portion of group one answers, and/or any portion of the group three answers. Product 126 may store (216) this information for each registration session completed successfully to provide a record that may be useful to a law enforcement agency if, for example, the product is found at a crime scene or is used at a crime scene. Product 126 may indicate (278) to the applicant that qualified registration is completed. And, registrar 204 may store (220) indicia of acknowledgement received (280, 282) from product 126.

If trusted communication is desired, instructions may be provided (960) to applicant 122 and set up (262) of product 126 for communication with network appliance 126 may occur as discussed above. A requirement or purpose of trusted communication may be (but need not be) described in these instructions.

Trust may be established between communicating entities as disclosed below. Other implementations according to various aspects of the present invention may include exchange of encryption keys, installing private encryption keys or secrets in the entities prior to communication, exchanging keys using Diffie-Hellman technology, using a public key infrastructure, or certificate verification.

In the methods described below, a nonce may be of any fixed or variable length depending on the capability of the product, the user interface to the product, the network appliance, and the interface between the product and the network appliance.

A process that determines that the source of information product 126 receives can be trusted by product 126 protects product 126 from accepting as legitimate, and talking action on, an unauthorized message or signal perhaps sourced from a system (not shown) operated to subvert qualified registration. Product 126 may establish that the source of information it receives can be trusted by selecting (208) and providing (268) a nonce (A) to the source of information and determining that a subsequently received (276) reply (B) is consistent with the nonce (A). Consistency arises because product 126 and the trusted source (204) are expected to have identical instances (213, 215) of a process for calculating the reply (B) for any given nonce (A).

The nonce (A) for a particular registration may be selected by each product and for each qualified registration session in a pseudo random manner. In one implementation, every product has an identical pseudo random number process (208). A seed for a particular nonce (A) may be prepared in accordance with information particular to the instance of the product 126 and/or the instance of the registration session. Instructions presented (260) to applicant 122 may direct applicant 122 to enter (262) information into product 126 as part of the set up for communication with network appliance 124. Such information may be used by nonce selection process 208 to select a nonce (A).

Information particular to the instance of product 126 may include a serial number of product 126 stored in the product at time of manufacture; and/or a description of a transaction that led to possession of the product by applicant 122. Instructions provided (260) to applicant 122 may guide applicant 122 to input to product 126 during set up (262) a description of a transaction. A description of a transaction may include an identifier of the person or entity that provided the product to the applicant (e.g., a seller's name, seller's tax identification number, seller's phone number, a uniform product code (UPC)), a location of the transaction (e.g., seller's GPS coordinates, seller's postal code), buyer's credit card number, and/or a date/time of the transaction (e.g., deduced by product 126 upon a first operation of a control of the product's user interface after product 126 is removed from its sales packaging).

Information particular to the instance of the current registration session may include a description of the session and/or a description of the applicant. A description of the session may include a date/time of the session, duration from start of session, a location of the session (e.g., current GPS coordinates, a local postal code, a local phone number) and/or any particulars of network appliance 124 such as a network address or disk space remaining. A description of the applicant may include any information provided in group one answers (234) or group three answers (246) discussed above, applicant's residence postal code, applicant's residence/employer/cellular phone number, and/or applicant's response to a request for an arbitrary number (e.g., as explained in instructions (260)).

Alter selecting a notice (A), product 126 may provide (268) the nonce (A) to applicant 122, via the product's user interface. Involving applicant 122 and user interfaces of product 126 and network appliance 124 greatly reduces the risk that an automated substitute for a person as applicant can be created for subversive purposes. Any technology for distinguishing a human may be used (e.g. a completely automated public turing test to tell computers and humans apart (CAPTCHA)). For example, product 126 may have a display by which applicant 122 may read nonce (A) as a numeric or alphanumeric value. For another example, product 126 may have a display by which applicant 122 may read nonce (A) as an image (e.g., an arbitrary hand drawn symbol such as a grid with particular squares blackened). For still another example, product 126 may have a speaker by which applicant 122 may direct sound into a microphone of network appliance 124 to convey an audio signal comprising nonce (A) (e.g., a self clocking shift keyed series digital signal, a synthetic voice reciting an arbitrary word or phrase such as a name of a city). Applicant may then enter (270) the nonce (A) into network appliance 124 in any conventional manner including as discussed above, or as an answer to a multiple choice question (e.g., for describing an image on a display of product 126), or as a series of answers to a series of multiple choice questions. Browser process 202 may forward (272) the nonce (A) (or applicant's entries) to registrar process 204.

Registration server 102 hosts process 213 to compute a reply (B) and provide (274) the reply (B) to browser process 202. Transmit to product process 214 may forward (276) the reply (B) to product 126. Product 126 hosts process 215, identical to process 213, to compute a value from nonce (A). If that value is consistent with the reply (B), then the source (registration server 102) is considered trustworthy by product 126. If not, product 126 terminates processing for the current registration session and may store 216 information describing the unsuccessful registration session. Termination prevents activation 217 of the intended product function. Termination also prevents presenting (278) an indication of successful registration to applicant 122 and acknowledgement (280, 282) from reaching registrar process 204.

A process that determines that the source of information received by registration server 102 can be trusted by registration server 102 protects registration server 102 from reverse engineering that could otherwise guide the design of a subversive apparatus for activating a product function without completing qualified registration with a legitimate registration server 102. Registration server 102 may establish that the source of information is a legitimate product 126 to be trusted (as opposed to a subversive apparatus) by selecting 209 and providing (264) a nonce (C) to the source of information and determining that a subsequently received (272) reply (D) is consistent with nonce (C). Consistency arises because the registration server and the trusted source are expected to have identical instances (211, 212) of a process for calculating the reply (D) for any given nonce (C).

The nonce (C) for a particular registration may be selected by each registration server and for each qualified registration session in a pseudo random manner. In one implementation, every registration server has an identical pseudo random number process (209). A seed for a particular nonce (C) is prepared in accordance with information particular to the instance of registration server 102 and/or the instance of the registration session. An authorized operator of registration server 102 may define and enter information discussed above into memory (not shown) of registration server 102. Such information may be used by nonce selection process 209 to select a nonce (C).

Information particular to the instance of registration server 102 may include a serial number of registration server 102 stored in registration server 102 at time of manufacture; and/or a description of a configuration of registration server 102. A description of configuration may include an identifier (e.g., network address), a location of the server presumed to be constant (e.g., facility GPS coordinates, facility postal code), and/or a date/time of establishing its configuration.

Information particular to the instance of the current registration session may include a description of the session and/or a description of applicant 122. A description of the session may include a date/time of the session, and/or a location of the session (e.g., current GPS coordinates, a local postal code, a local phone number). A description of applicant 122 may include any information provided in group one answers (234) or group three answers (246) discussed above, applicant's residence postal code, applicant's residence/employer/cellular phone number, and/or applicant's response to a request for an arbitrary number (e.g., obtained in response to the group one questions).

After selecting a nonce (C), registrar process 204 may provide (264) the nonce (C) to browser process 202. Browser process 202 may then forward (266) the nonce (C) to product 126 via transmit to product process 210. Product 126 hosts process 211 to compute a reply (D) and present (268) the reply (D) to applicant 122 via a user interface or output device of product 126. Applicant 122 determines the reply (D) and other information (e.g., product 126 serial number) in any conventional manner from a user interface of product 126. Applicant 122 inputs into network appliance 124 the reply (D) and other information (e.g., a serial number of product 126) into any input device of network appliance 124 and in any conventional manner. For example, product 126 may have a display from which applicant 122 may read reply (D) and network appliance 124 may have a keyboard by which applicant 122 may type in reply (D). For another example, product 126 may have a display (or speaker) and network appliance 124 may have a camera (or microphone) by which applicant 122 holds the display in view of the camera (or speaker within range of the microphone) to complete the entry of reply (D) into network appliance 124. Reply (D) may be an image (e.g., any two dimensional symbol, a bar code). Reply (D) may be sound (e.g., a self clocking shift keyed series of audio tones, a synthetic voice reciting a word or phrase). Browser process 202 forwards the reply (D) to registration server 102. Registration server 102 hosts process 212, identical to process 211, to compute a value from the nonce (C). If that value is consistent with the reply (D), then the source of information (product 126) is considered trustworthy by registration server 102. If not, registration server 102 terminates processing for the current registration session. Termination prevents providing (274) indicia of successful registration to browser process 202. Consequently, termination prevents activation 217 of the intended product fiction and prevents presenting (278) an indication of successful registration to applicant 122.

According to various aspects of the present invention, a product may present via a user interface its serial number and a code. Use of the code makes reverse engineering unlikely to be successful and unauthorized activation of product functions to be unlikely. The serial number may be used by a registration server to create an entry in a database that associates identification of a successful registration applicant with identification of a product (e.g., the product's serial number). Typically, the serial number of a product is evident from an inspection of the product even if the product is not functional. If the serial number is communicated to the registration server in an encrypted form, reverse engineering to crack the encryption may be guided by knowledge of the serial number and a presumption that the registration server would receive a product serial number from the product during qualified registration. Consequently, the security provided by encryption would be compromised. Accordingly, the serial number, in a preferred implementation of a system in accordance with various aspects of the present invention, is provided in an unencrypted form. Nevertheless, the conclusions of trustworthy sources of information as discussed above are not compromised because use of the code makes reverse engineering unlikely to be successful and unauthorized activation of product functions to be unlikely.

Figure 2C:
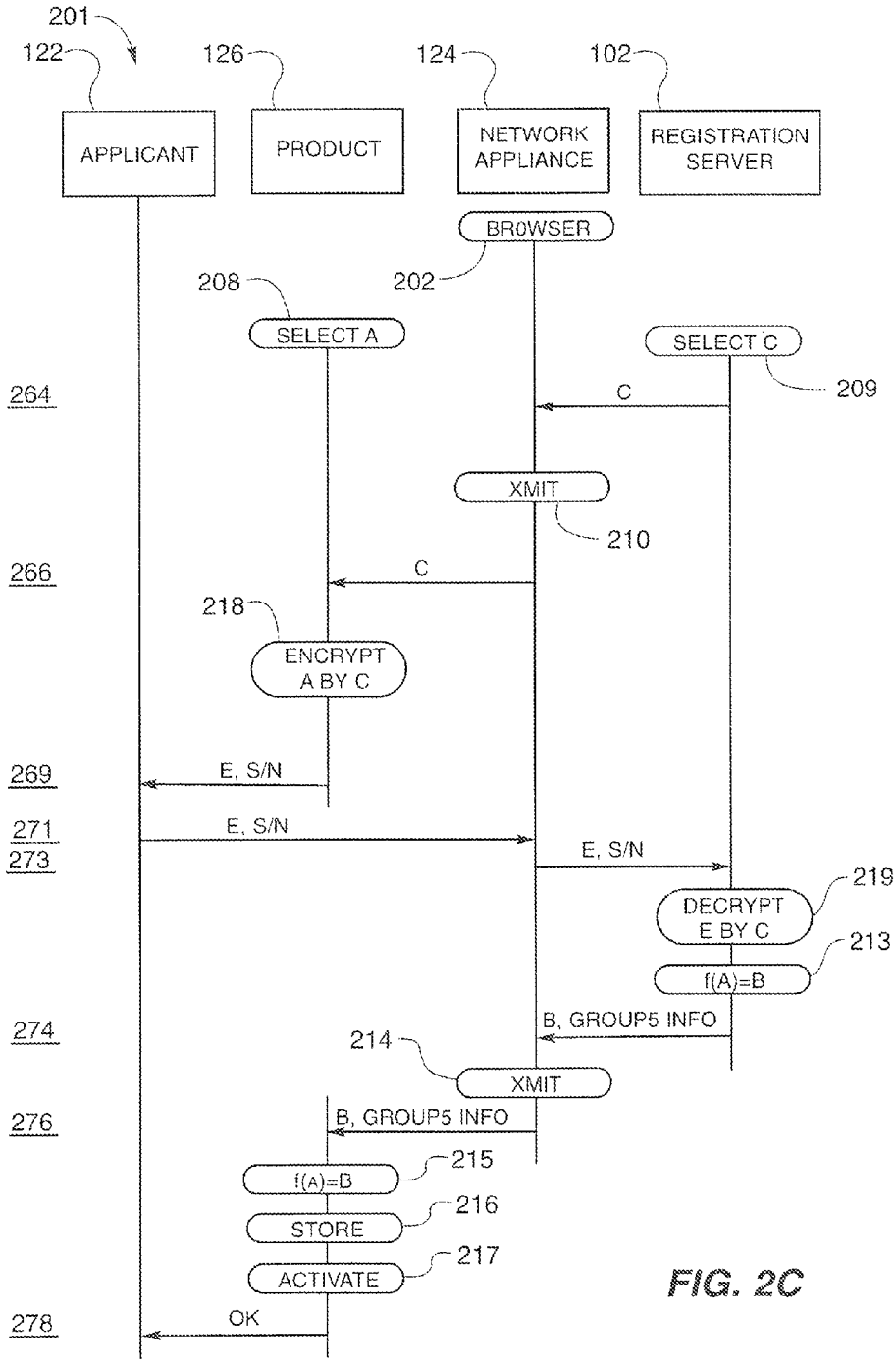
FIG. 2C is a message sequence diagram of another method for qualified registration in the environment of FIG. 1.

A variation of sequence 200 replaces messages and/or signals 264 through 278 of FIGS. 2A and 2B with sequence 201 having messages and/or signals 264 through 268 of FIG. 2C. To limit the quantity of information presented to applicant 122 and subsequently input by applicant 122 to network appliance 124, providing (268), inputting (270), and forwarding (272) reply (D) as discussed above with reference to FIGS. 2A and 2B may be omitted. Instead, referring to FIG. 2C, a code (E) may be provided (269), inputted (271), and forwarded (273) with the serial number of product 126. The code (E) may be computed by applying encryption to nonce A using a key of nonce C. When registration server 102 receives (272) the code (E), knowledge of nonce C (from process 209 hosted by registration server 102) is sufficient for registrar process 204 to decrypt the code (E) to determine nonce A. Registration server 102 may conclude that the source of information that provided the code (E) is trustworthy because product 126 and registration server 102 have compatible encryption and decryption processes (218 and 219).

Figure 2D:
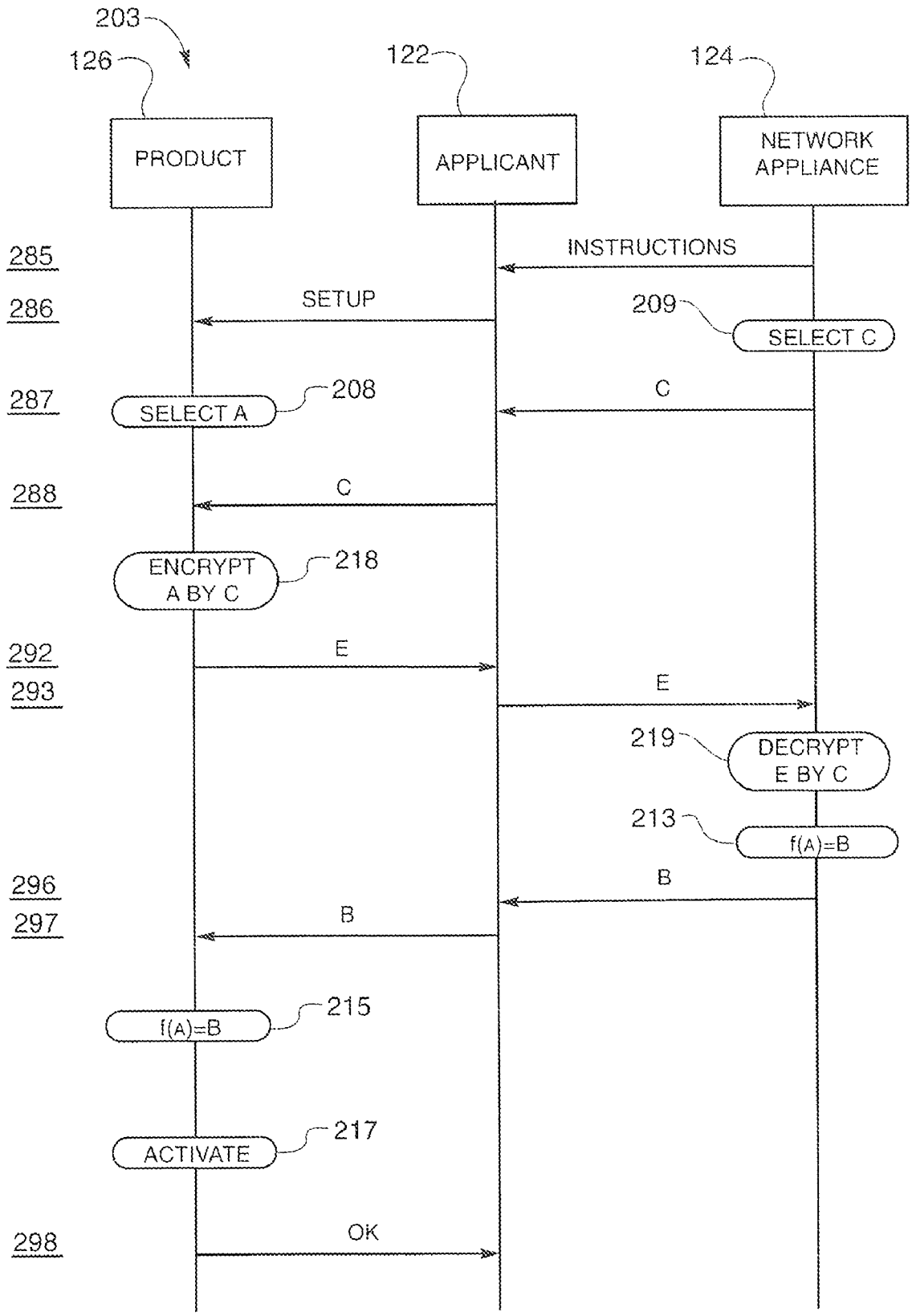
FIG. 2D is a message sequence diagram of another method for qualified registration in the environment of FIG. 1.
Figure 3:
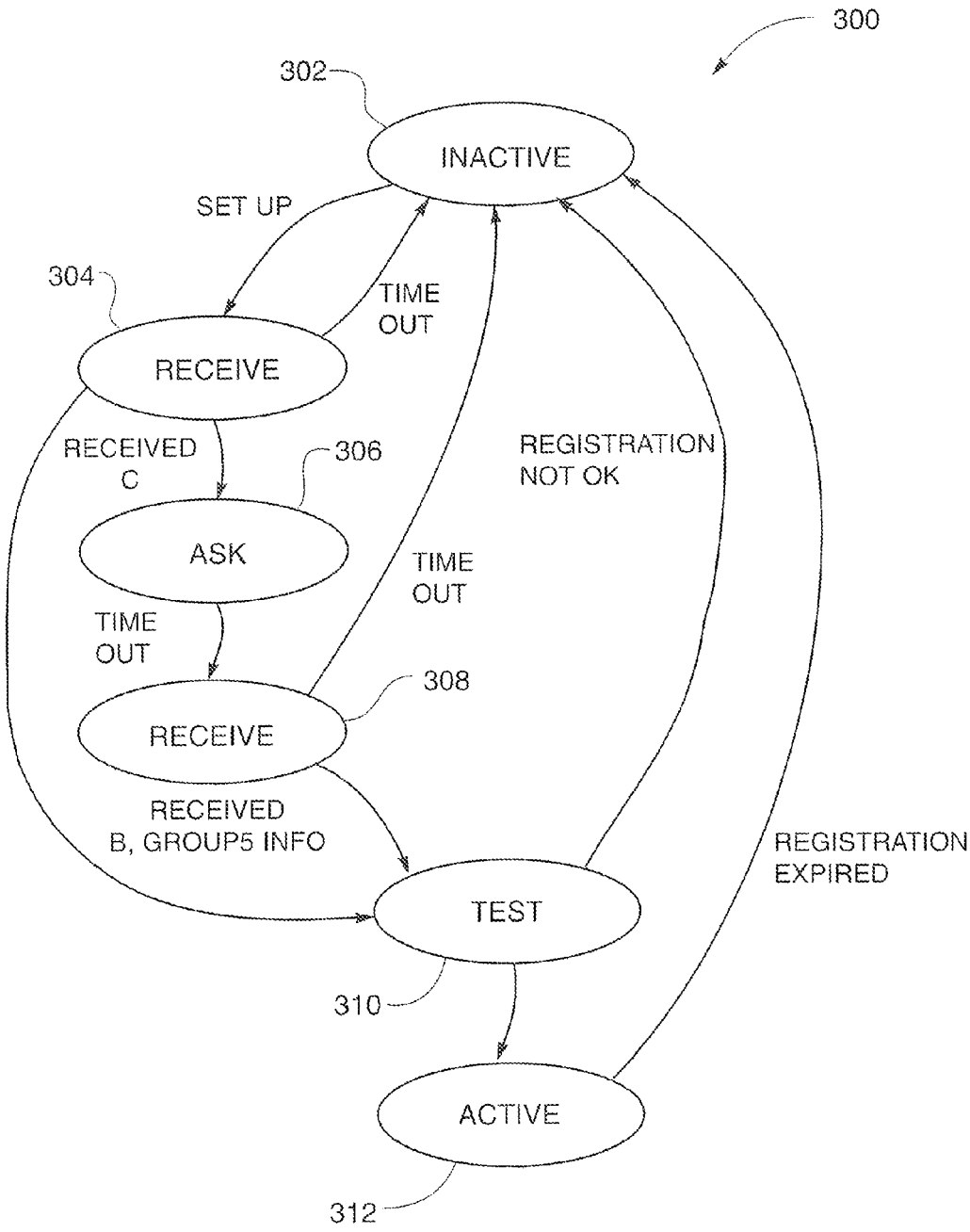
FIG. 3 is a state transition diagram of a logic circuit of the product of FIG. 1.
Figure 4:
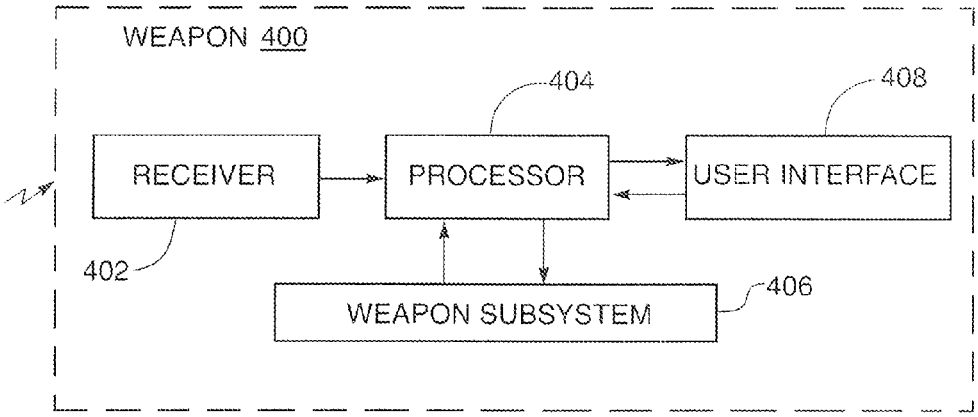
FIG. 4 is a functional block diagram of a weapon type of product of FIG. 1.
Figure 5:
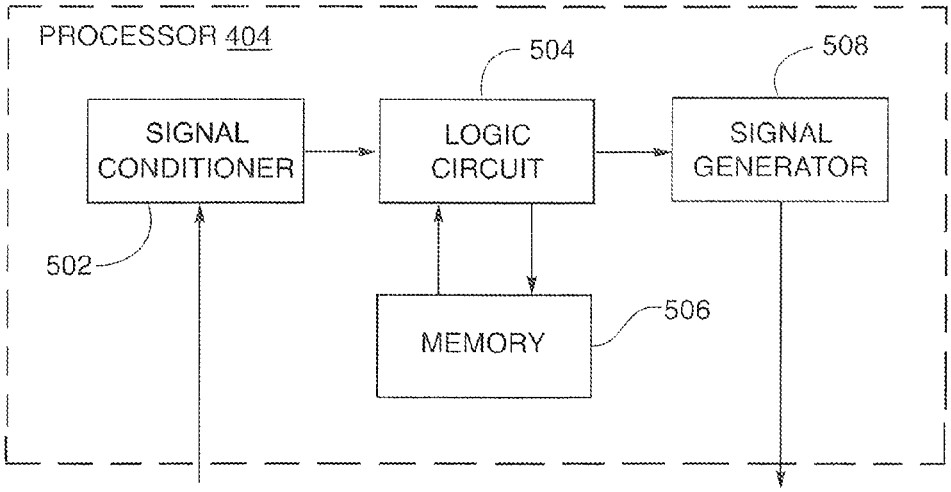
FIG. 5 is a functional block diagram of a processor of the weapon of FIG. 4.

Another variation of sequence 200 replaces messages and/or signals 260 through 278 of FIGS. 2A and 2B with sequence 203 having messages and/or signals 285 through 298 of FIG. 2D. In sequence 203, an applicant communicates with a network appliance; and a product communicates with the applicant. A simpler user interface on the product may result. For example in sequence 203, network appliance 124 may provide to applicant 122 instructions (285) that explain how to prepare (286) the product for receiving information. Applicant may operate the product (SET UP) according to the instructions (285). Network appliance, after a suitable allowance for product set up, or after a signal (not shown) from applicant 122, performs a process to select (209) a nonce (C) and provides (287) the nonce (C) to applicant 122. For a network appliance having a browser 202 and displays the nonce (C) may be presented visually to the applicant 122 as a string of letters, digits, or symbols and may use CAPTCHA technology as discussed above. For an audio network appliance, a human or synthetic voice may enunciate the nonce (C) to the applicant 122. Using a user interface of product 126, applicant 122 enters (288) the nonce (C) into the product. Product 126 may perform processes (e.g., analogous to 208, 218) for selecting a nonce (A) and for encrypting the nonce (A) in accordance with the received nonce (C). Using a user interface of product 126 (e.g., the same or different from entry at 288), product 126 may provide (292) to applicant 122 a reply (E) that applicant 122 enters (293) into network appliance 124 (e.g., via a keyboard or by speaking). In response to the reply (E), network appliance 124 may decrypt (219) the reply (E) in accordance with nonce (C) to determine a value (e.g., A); and then determine (213) a second nonce (B). Nonce (B) may then be provided (296) to applicant (122) and entered (297) by applicant in product 122 in a manner analogous to handling of the first nonce (C). The product 122 may test (215) the authenticity of the second nonce (B) and if authentic activate (217) the product for some or all functions. The product may report (298) status of activation (e.g., OK or not OK) to applicant 122.

Sequence 203 illustrates omission of the product providing a serial number as may be desired in a particular implementation to simplify communication possibly at the expense of recording the serial number of an activation by registrar process 204. In another implementation of sequence 203, signals, messages, and processes for establishing trust are also omitted as may be desired to simplify the product and/or the user interaction with the product. For example, processes 208, 209, 218, 219, 213, and 215 are omitted, messages for nonces (C), (E), and (B) are omitted, and network appliance 124 simply provides with instructions (285) sufficient information (286) to activate (217) the product.

A user interface for inputting information (e.g., a nonce or activation code) into a product may be implemented with a product that includes a switch and an indicator. The switch may be operated by the user who places the switch in one of two or more positions. By placing the switch in a predefined position, toggling between positions, or in a sequence of positions according to a switching schedule over time, a processor of the product may determine that the user intends to enter particular information. For example, the following actions by a user according to a predefined switching schedule may be interpreted by the processor as a request to enter a mode of operation for qualified registration (e.g., SET UP): placing an on/off switch in the "on" position, waiting about 1 second, toggling the switch (on/off/on), waiting about 1 second, toggling the switch a second time, and waiting for more than about 2 seconds with the switch in the "on" position. As another example, the following actions by a user according to a second predefined switching schedule may be interpreted by the processor as input of a digit a string used as a nonce or activation code: with the switch in the "on" position, waiting a duration proportional to the digit, and setting the switch to the "off" position. The product may include an indicator (e.g., an LED) that indicates intervals of time (e.g., with a flash of light that the user counts) for an integer number of time intervals corresponding to the digit being entered. The entry of a series of digits may proceed by repeating the second switching schedule. Each repetition when completed may be acknowledged by the product (e.g., stopping flashing of the LED by leaving the LED on for a predetermined time such as about 5 seconds).

A user interface for outputting information (e.g., a nonce, mode, or status indication) from a product may be implemented with a product that includes a switch and an indicator. The switch may be operated by the user who places the switch in one of two or more positions. By placing the switch in a predefined position, toggling between positions, or in a sequence of positions according to a switching schedule over time, a processor of the product may determine that the user intends to receive particular information. After completing inputting as discussed above, the product may provide information without further prompt by the user (e.g., after a suitable delay to allow the user to be ready to receive information). For example, the indicator (e.g., an LED) may be flashed for the user to count the flashes and held on or off to indicate the end of flashing of each digit of information.

Use of one or more indicators for inputting information and for outputting information may be distinguished by use of more than one indicator and/or use of a different type of indicator (e.g., colors of light, types of sounds, varieties of vibration) for each purpose. For example, inputting and outputting may be juxtaposed or interleaved when inputting comprises flashes red light and outputting comprises flashes of green light.

The interfaces described above between an applicant and a product may be automated in any suitable manner for an implementation of interfaces between the product and a network appliance.

A product, according to various aspects of the present invention, may include a state machine with particular states and transitions between states. The state machine may be implemented as a processor (e.g. processing circuit, stored program processor, logic circuit, microprocessor, microcontroller). A logic circuit may implement states using memory (e.g., flip flops). A processor may implement states using memory (e.g., a program pointer, a stack of program pointer values, a register of condition values). Any desired amount of processing may occur while the state machine remains in a particular state. From the point of view of product 126, qualified registration involves six states. For example, state transitions 300 of product 126 (e.g., a weapon as discussed above) include inactive state 302, receive state 304, ask state 306, receive state 308, test state 310, and active state 312.

In inactive state 302, the state machine awaits action by the user of product 126 (e.g., applicant 122 at 262 as discussed above). On recognizing that action by the user (e.g., set up) is complete, the state machine transitions from inactive state 302 to receive state 304. Inactive state 302 may be a low power consumption state having little if any processing. In one implementation processing is limited to occasionally verifying that set up is not yet complete. In another implementation, state 302 does not permit any processing and set up includes applying power to the state machine that initially begins in state 304.

In receive state 304, the state machine awaits reception (266) of nonce C. Because nonce C cannot be predicted by product 126, nonce C may be formatted in a message provided by transmit to product process 210 in any conventional manner with predictable information so that the message as a whole conforms to an expected format to avoid misunderstanding noise as a value for nonce C. Select nonce (A) process 208 may be accomplished while in receive state 304. On receiving nonce C, the state machine transitions to ask state 306. Time may be measured (e.g., counted down) in receive state 304 to allow a reasonable duration for set up to be completed by applicant 122. If a timeout occurs while in receive state 304, the state machine transitions back to inactive state 302.

In ask state 306, process 211 (FIGS. 2A and 2B) or process 218 (FIG. 2C) is performed and a presentation, message, or signal is formed. The presentation, message, or signal may in addition include a nonce (A), a reply (D), and/or a serial number of product 126. When prepared, the presentation, message, or signal is presented (268) to applicant 122 using a user interface or other output device of product 126. Time may be measured (e.g., counted down) in ask state 306 to allow a reasonable duration for transfer of the information conveyed by the presentation, message, or signal to be accommodated by network appliance 124. When timeout occurs, the state machine transitions from ask state 306 to receive state 308.

In receive state 308, the state machine awaits reception (276) of a reply B and group five information (if any). Reply B and group five information may be formatted in a manner analogous to the formatting of nonce C discussed above. When reception is complete, the state machine transitions to test state 310. Time may be measured (e.g., counted down) in receive state 308 to allow a reasonable duration for registrar 204, network communication with network appliance 124, and any further instructions or set up (not shown) to be completed by applicant 122. If a timeout occurs while in receive state 308, the state machine transitions back to inactive state 302.

In test state 310, the state machine may perform process 215 and conclude whether activation of the intended function of product 126 may occur. If process 215 indicates registration is unsuccessful, an error presentation, message, or signal may be provided to applicant 122 or on a link to registration server 102 as discussed above. After a reasonable delay for presentation of the error message to applicant 122, the state machine transitions back to inactive state 302. If, on the contrary, process 215 indicates that the source of received information may be trusted and registration was successful, then state machine 310 may perform processes 216 and 217, advise (278) applicant 122, and transition to active state 312.

Product 126 may include a weapon. For example, weapon 400 of FIG. 4 includes receiver 402, processor 404, user interface 408, and weapon subsystem 406. Conventional circuits may be used to implement product 126 modified and supplemented as taught herein.

Receiver 402 receives (266, 276) information from a network appliance. Reception may be by connection to the network appliance (e.g., a USB cable), via a user interface (e.g., light, sound), and/or via a link (e.g., wireless network, radio). Receiver 402 includes one or more suitable detectors and circuitry for reliable reception of the information. Received information is provided to processor 404.

Processor 404 may include any conventional implementation of a state machine as discussed above with reference to state transitions 300. Processor 404 may in addition include processes, memory, and input/output functions mid structures implemented in any combination of hardware, firmware, and/or software. Processor 404 performs processes 208, 211, 215, 216, and 217, discussed above. In addition, processor 404 may perform suitable communication processes (not shown) in support of communication via receiver 402 (e.g., decoding, unformatting, error detecting). Further, processor 404 may include circuits and perform all suitable processes in support of weapon subsystem 406 (e.g., timing, control, obtaining status).

User interface 408 may include switches and indicators for control and status of conventional weapon functions (e.g., safety, trigger, reapplication of electrical stimulus, range priority selection). According to various aspects of the present invention, one or more status indicators, a display, speaker, link, or other output device of weapon 400 may be used to communicate (268, 278) with applicant 122 or network appliance 124. In one implementation receiver 402 is omitted and an input device (e.g., microphone, camera) of user interface 408 is used to receive information (266, 276) from network appliance 124. User interface 408 cooperates with processor 404 to provide indicia of user set up and operation of weapon 400 to processor 404; and to indicate, display, or transmit data (e.g., status, messages, signals) from processor 404 to the user of weapon 400 or to network appliance 124.

Weapon subsystem 406 includes any conventional weaponry apparatus (e.g., a mechanism or circuit) for implementing all conventional operations of a lethal or nonlethal firearm, mine, projectile, or electronic control device. For example, for an implementation of weapon 400 as an electronic control device, weapon subsystem 406 may include magazine, cartridge, or projectile circuitry of the type that produces a current through skeletal muscles of a human or animal target to halt locomotion by the target. Such an electronic control device may implement a local stun function where weapon 400 is held against or proximate to tissue of the target so that the current can arc to pass through the target. Such an electronic control device may implement a remote stun function where weapon 400 launches one or more wire tethered darts that conduct the current from a signal generator in weapon 400 to a remote target (e.g., about 15 feet (5 meters) from weapon 400). The portion of weapon subsystem 406 that communicates with processor 404 may perform the functions of a magazine, cartridge, projectile, and/or launch device (e.g., for electronic projectiles or wire tethered darts)). In addition, weapon subsystem may include peripheral input and output devices related to weaponry including, for example, a video camera (aimed toward the target), a cellular phone link, a global positioning system (GPS) receiver, a user identification apparatus (e.g., biometric sensor), a sound recorder, and/or a sound emitter or speaker for alarms or synthesized voice.

A processor for a weapon may perform the functions discussed above with reference to product 126 and perform none, some, or all of the functions discussed above with reference to weapon processor 404 and the processing functions of weapon subsystem 406. For example, processor 404 of FIG. 5 serves as the primary (or central) processor for al electronic weapon implementation of product 126. Processor 404 of FIG. 5 includes signal conditioner function 502, logic circuit 504, memory 506, and signal generator function 508.

Signal conditioner function 502 may include electrical bias and/or detectors for manually operated controls of user interface 408 and detection circuitry for status of weapon subsystem 406. Conventional circuits and techniques may be used.

Logic circuit 504 may include a microcontroller, microprocessor, or state machine programmed or implemented to perform processing functions particular to a weapon. Logic circuit receives input signals from signal conditioner 502. Logic circuit 504 receives data, state, and operating instructions from memory 506; and stores data, new states and program control information in memory 506. Logic circuit 504 outputs control signals to signal generator 508. Logic circuit 502 may include hardware and/or software for maintaining time of day, date, and for measuring durations governing state changes and weapon functions.

Memory 506 may include any conventional nonvolatile or volatile storage including magnetic, optical, and semiconductor storage technologies. A portion of memory 506 may be removable to facilitate, for example, upgrading processing by processor 404, or transfer of information from weapon 400 to other systems.

A signal generator may use conventional technologies to generate signals used within weapon 400 and transmitted out of weapon 400. For an electronic control device, signal generator 508 suitably includes a high voltage power supply for generating a signal sufficient to ionize air and form one or more arcs to complete a circuit through the target. Signal generator 508 may also generate the current used to halt locomotion by the target for local and/or remote stun functions as discussed above.

Weapon 400 in operation includes an inactive state and an active state as discussed above. Use in the active state may be continuous, as needed, occasional, or intermittent without necessarily bringing about a reversion to the inactive state. One, some, or all of the functions of signal generator 508 may be disabled while weapon 400 is in an inactive state. To enable one, some, or all disabled functions, qualified registration as discussed above must be successfully accomplished. Qualified registration by one applicant may enable a first group of functions (e.g., a local stun function, limited range function with particular cartridge types). Qualified registration by another applicant may enable a second different group of functions in the same or a different weapon.

Registration may expire. To assure that the user has sufficient notice of pending or current expiration, the product may include an indicator (e.g., "ready"/"not ready", or "service needed") and a control, operation of which reinstates the inactive state. For example, opening an enclosure of the product, performing periodic maintenance (e.g. replacing batteries), or effecting configuration changes, upgrades, troubleshooting or repair may actuate the control to cause expiration and consequently require re-registration.

Expiration and re-registration of applicants using qualified registration as discussed above may facilitate management of user training, both initial user education and continuing education, for users of products. For example, a basic weapon function may require completion of basic training. Satisfactory completion of training may be logged in a database maintained by registration server 102 or qualification server 104. If maintained by registration server 102, registrar process 204 may perform a portion of the qualifier process as to training criteria, qualifications, questions, and answers. Instead, training records may be provided (236) to qualification server 104 (e.g., added to group one answers to provide group two answers) for qualifier process 206 to analyze and integrate with other criteria, qualifications, questions, summaries, weights, ranks, and/or scores. A registered user's training records may be stored by (e.g., in) product 126 (216) with group five information as discussed above. A processor of product 126 (e.g., processor 404 or weapon 400) may supply training status to a user interface (e.g., 408, or 124) to inform a user of what functions of the product are enabled, when registration expires, what functions are available with additional registration, and/or how to apply for additional registrations (e.g., a URL suitable for each registration).

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A weapon comprising:

a processor that performs a function of the weapon;

a description of the weapon provided by the weapon to the user for transmission by the user via a provided network; and a user interface for providing to the processor a code received via the network; wherein:

the code is received by the user via the network in accordance with the description;

the code is provided by the user to the user interface;

the code indicates a qualified user and a registered weapon;

receipt of the code enables the processor to perform the function of the weapon.

2. The weapon of claim 1 wherein the user receives the code from a network appliance coupled to the network.

3. The weapon of claim 1 wherein the user receives the code in response to a radio signal provided by the network.

4. The weapon of claim 1 wherein the function comprises exerting a force against a provided target.

5. The weapon of claim 1 wherein:

the user interface provides an information from the processor to the user of the weapon; and the code is provided by the network in response to an action by the user performed in accordance with the information.

6. The weapon of claim 5 wherein the information is provided for the user to hear.

7. The weapon of claim 5 wherein the information is provided for the user to see.

8. The weapon of claim 5 wherein:

the user interface further provides to the processor a description received from the network; and the weapon further comprises a memory that stores data in accordance with the description.

9. The weapon of claim 8 wherein the description received from the network describes the user.

10. The weapon of claim 1 wherein the function comprises providing an arc of current.

11. The weapon of claim 1 wherein the function comprises launching a dart toward a provided target.

12. The weapon of claim 1 wherein the function comprises launching a projectile toward a provided target.

13. The weapon of claim 1 wherein the code is received for the user to hear.

14. The weapon of claim 1 wherein the code is received for the user to see.

15. The weapon of claim 1 wherein the network provides the code to the user only after qualification of the user and registration of the weapon.

16. The weapon of claim 1 wherein the user interface provides the description of the weapon from the processor to the user.

17. The weapon of claim 16 wherein the description comprises a serial number.

18. The weapon of claim 1 wherein:

the user interface comprises a switch; and the user manually operates the switch to provide the code to the user interface.

19. The weapon of claim 1 wherein:

the user interface comprises a microphone; and the user speaks into the microphone to provide the code to the user interface.

20. The weapon of claim 1 wherein:

the user interface comprises an indicator; and the indicator provides an acknowledgment of a receipt of the code.

21. The weapon of claim 1 wherein the code comprises an information about the qualified user.

22. The weapon of claim 1 wherein the code enables the weapon to perform the function for a registration period.

23. A method performed by a weapon for enabling the weapon to perform a function, the weapon comprising a user interface, the method comprising:

providing a description of the weapon to a user for transmission by the user via a network;

detecting one or more operations of the user interface by the user, the user interface operated in accordance with a code received by the user via the network;

in accordance with detecting, receiving the code; and in accordance with the code, enabling the weapon to perform the function; wherein:

the code is received by the user via the network in accordance with the description; and the code indicates a qualified user and a registered weapon.

24. The method of claim 23 wherein the code enables the weapon to perform the function for a registration period.

25. The method of claim 23 wherein:

the user interface comprises a switch; and detecting comprises detecting an operation of the switch by the user.

26. The method of claim 23 wherein:

the user interface comprises a microphone; and detecting comprises detecting audible speech of the user.

27. The method of claim 23 further comprises providing an acknowledgement of an operation of the user interface.

28. The method of claim 27 wherein providing comprises illuminating an indicator of the user interface.

29. The method of claim 23 further comprises providing an acknowledgement of a receipt of the code.

30. The method of claim 29 wherein providing the acknowledgement comprises illuminating an indicator of the user interface.

31. The method of claim 23 wherein providing the description comprises providing a serial number.

32. The method of claim 23 wherein providing the description comprises providing a visual indication via the users interface.

33. The method of claim 23 wherein providing the description comprises providing audio via the users interface.

34. The method of claim 23 wherein the code comprises information about the user.

* * * * *